US011473226B2

(12) United States Patent
Collins et al.

(10) Patent No.: US 11,473,226 B2
(45) Date of Patent: Oct. 18, 2022

(54) METHOD OF CONSTRUCTING A CIRCULAR-KNITTED COMPRESSION GARMENT

(71) Applicant: BSN medical, Inc., Charlotte, NC (US)

(72) Inventors: Larry W. Collins, Connelly Springs, NC (US); Phillip T. Clark, Granite Falls, NC (US)

(73) Assignee: BSN MEDICAL, INC., Charlotte, NC (US)

( * ) Notice: Subject to any disclaimer, the term of this patent is extended or adjusted under 35 U.S.C. 154(b) by 0 days.

(21) Appl. No.: 17/405,850

(22) Filed: Aug. 18, 2021

(65) Prior Publication Data

US 2021/0372017 A1 Dec. 2, 2021

Related U.S. Application Data

(62) Division of application No. 15/981,046, filed on May 16, 2018, now Pat. No. 11,142,852.

(51) Int. Cl.
*D04B 1/12* (2006.01)
*A41B 11/00* (2006.01)
(Continued)

(52) U.S. Cl.
CPC ..... *D04B 1/126* (2013.01); *A41B 11/001* (2013.01); *D04B 1/26* (2013.01); *D04B 9/52* (2013.01);
(Continued)

(58) Field of Classification Search
CPC .. D04B 1/126; D04B 1/26; D04B 9/52; A41B 11/001; A41B 2500/10; D10B 2501/012
See application file for complete search history.

(56) References Cited

U.S. PATENT DOCUMENTS 3,079,780 A 3/1963 Kale et al.
3,386,270 A 6/1968 Simmons
(Continued)

FOREIGN PATENT DOCUMENTS

BE 905620 A 2/1987
GB 460771 A 2/1937
(Continued)

OTHER PUBLICATIONS

PCT Written Opinion of the International Searching Authority for PCTUS2018032922; dated Jan. 16, 2019; 8 pages.
(Continued)

*Primary Examiner* — Danny Worrell
(74) *Attorney, Agent, or Firm* — Shumaker, Loop & Kendrick, LLP; S. Alexander Long, Jr.

(57) ABSTRACT

A method of constructing a compression garment, for example, a sock, formed of a knitted fabric that includes an elastomer compression inlay yarn introduced into a predetermined first selection of needles on a first knitting machine finger position and first and second pattern yarns introduced into a predetermined second selection of needles on second and third knitting machine finger positions, the first selection of needles and the second selection of needles collectively defining a predetermined pattern. When the predetermined second selection of needles is raised to take on the first and second pattern yarns, the elastomer compression inlay yarn deflects predetermined ones of the second selection of needles radially inwardly to define an annular space into which the pattern yarns are dropped in an offset relation to the elastomer compression inlay yarn. The first and second pattern yarns are plated to respective outer and inner surfaces of the fabric, and the elastomer compression yarn are inlaid to the inner surface of the fabric.

37 Claims, 12 Drawing Sheets

(51) Int. Cl.
*D04B 1/26* (2006.01)
*D04B 9/52* (2006.01)

(52) U.S. Cl.
CPC ..... *A41B 2500/10* (2013.01); *A41B 2500/50* (2013.01); *D10B 2401/061* (2013.01); *D10B 2501/021* (2013.01)

(56) References Cited

U.S. PATENT DOCUMENTS

| | | | |
|---|---|---|---|
| 3,956,906 | A | 5/1976 | Cassidy, Sr. |
| 4,027,667 | A | 6/1977 | Swallow et al. |
| 4,172,456 | A | 10/1979 | Zens |
| 4,522,044 | A | 6/1985 | Lineberry et al. |
| 5,186,025 | A | 2/1993 | Neher |
| 6,311,334 | B1 | 11/2001 | Reinhardt et al. |
| 7,721,575 | B2 | 5/2010 | Yokoyama |
| 7,971,280 | B2 | 7/2011 | Kaneda |
| 8,973,411 | B2 | 3/2015 | Gaither |
| 9,387,125 | B1 | 7/2016 | Duda |
| 11,142,852 | B2 * | 10/2021 | Collins ..... D04B 9/52 |
| 2008/0171959 | A1 | 7/2008 | Achtelstetter |

FOREIGN PATENT DOCUMENTS

| | | | |
|---|---|---|---|
| GB | 2144153 | A | 2/1985 |
| WO | 2009136063 | A1 | 11/2009 |
| WO | 2012067645 | A1 | 5/2012 |

OTHER PUBLICATIONS

PCT International Preliminary Report on Patenability for PCTUS2018032922; dated Nov. 26, 2020; 9 Pages.

PCT International Search Report and Written Opinion for PCTUS2018032922; dated Jan. 16, 2019; 6 pages.

* cited by examiner

METHOD OF CONSTRUCTING A CIRCULAR-KNITTED COMPRESSION GARMENT

PRIORITY CLAIM

This application claims priority from U.S. patent application Ser. No. 15/981,046, filed May 16, 2018, the contents of which are incorporated by reference in this application.

TECHNICAL FIELD AND BACKGROUND OF THE INVENTION

This invention relates to compression garments, and more specifically to compression garments such as compression hosiery products, and a method of producing a compression hosiery product that eliminates disadvantages inherent in current types of compression hosiery, particularly those types of compression hosiery that attempt to give the appearance of a patterned non-compression hosiery product.

The patterned compression hosiery of the invention uses a plating technique that includes two different fiber types that alter the appearance of the pattern repeats of the hosiery. The technique enables the inner surface of the hosiery to be smooth without ridges created by the patterning and loose threads and loops on the interior of current types of compression hosiery that can create corresponding indentations on the surface of the legs of the wearer or cause the wearer to catch a toe in one of the loops. Indentations on the leg of a wearer are particularly objectionable when worn by persons with compromised lower body venous capacity.

The invention has the appearance of a hosiery product, such as a sock, patterned on a single-feed knitting machine, but that is made on, for example, a 4-feed compression knitting machine utilizing both elastomer compression yarns and non-elastomer yarns. The method of knitting the hosiery includes creating a pattern using feeds 2 and 4, while inlaying compression yarns using feeds 1 and 3. In one embodiment of the invention, a computer-generated pattern design is manipulated to create a pattern symmetrical top to bottom and side to side. This is distinct from typical patterns on 4-feed machines which appear elongated along the axis of the leg of the garment.

Another feature of the invention is the ability to create 2-color patterns that have varying textures providing a more interesting and pleasing appearance.

Prior art publications include US Publication No. 2008/0171959, which discloses a compression article, particularly a compression stocking or compression tights, made of an elastic knitted fabric (1) with a base knitted fabric (2), which is made from a knitting thread (S) and inside of which are deposited compression-imparting compression threads (K). In order to obtain a surface pattern, the manner in which the compression threads (K) are deposited alternates area by area.

U.S. Pat. No. 3,956,906 discloses a method of knitting a control top panty hose in which the panty portion is knit with spandex yarn and textured stretch yarn to form an attractive pattern of relatively opaque areas and open lace areas. The panty portion provides sufficient compressive force to control and shape the figure of the wearer and the open lace areas permit the passage of air.

U.S. Pat. No. 4,027,667 discloses a compression lower body garment intended to achieve a surface pattern (FIGS. 1-3 and 8, and col. 4, lines 36-68).

British Patent Application GB 2,144,153 discloses creation of a patterned knitted fabric by controlled adjustment of cam boxes to influence the needles based on the shape of the cams on two or more cam carriers.

U.S. Pat. No. 6,311,334 discloses a compression hose made of an elastic textile base material for the treatment of leg conditions. A rhombic, i.e., "diamond-shaped" lattice is integrated into the base material, with diagonals of the rhombuses lying in the longitudinal direction of the hose, and with intersecting strips which extend helically and continuously obliquely relative to the longitudinal direction of the hose to form the rhombic lattice.

SUMMARY OF THE INVENTION

It is therefore an object of the invention to provide a compression hosiery product that has a decorative pattern similar to a non-compression hosiery product.

It is another object of the invention to provide a compression hosiery product that has a smooth interior surface free of loose threads and ridges.

It is another object of the invention to provide a compression hosiery product that permits a broad range of decorative patterns.

It is another object of the invention to provide a compression hosiery product that has, for example, three yarns—an inlay yarn and two plating yarns.

It is another object of the invention to provide a compression hosiery product that is constructed having two pattern feed yams and one or more inlay feed yarns.

It is another object of the invention to provide a method of forming a compression hosiery product that has a decorative pattern similar in appearance to a non-compression hosiery product.

It is another object of the invention to provide a method of forming a compression hosiery product that has a smooth interior surface free of loose threads and ridges.

It is another object of the invention to provide a method of forming a compression hosiery product having two pattern feed yarns.

These and other aspects of the invention are achieved by providing a method of constructing a circular-knitted compression garment including the steps of providing a circular knitting machine adapted for laying in an elastomer inlay compression yarn during circular knitting operation, circular knitting the compression garment with first and second plated pattern yarns collectively defining a predetermined pattern visible on an outer surface of the compression garment and laying into a structure of the first and second plated pattern yarns an elastomer inlay compression yarn as a portion of an inner surface of the circular-knitted garment. The elastomer inlay compression yarn and the first and second plated pattern yarns collectively define respective inner and outer surfaces of the circular-knitted garment. The garment is knitted according to a step whereby the predetermined pattern of the circular-knitted garment is characterized by extending around a circumference of the garment with the inner surface of the circular-knitted garment being smooth without loops and strings extending into an interior volume of the garment defined by the inner surface of the circular-knitted garment.

According to another aspect of the invention, the step of circular knitting the compression garment comprises the step of circular knitting a compression hosiery product.

According to another aspect of the invention, the elastomer compression yarn is a spandex yarn covered with at least one yarn selected from the group of yarns consisting of nylon, polyester, polypropylene, cotton, rayon, wool and silk.

According to another aspect of the invention, the method includes the step of selecting for the first pattern yarn a pattern yarn that has a composition that takes on a dye differently than the second pattern yarn takes on a dye, resulting in a pattern that is distinguishable by a different color appearance of the yarns.

According to another aspect of the invention, the step of knitting at least one of the first and second pattern yarns includes the step of knitting with a cotton yarn.

According to another aspect of the invention, the step of laying in the elastomer compression yarn includes the step of laying in a spandex yarn wrapped with two layers of textured nylon yarn.

According to another aspect of the invention, the step of knitting the predetermined pattern of the circular-knitted garment includes the step of knitting a predetermined pattern that extends continuously around the circumference of the garment.

According to another aspect of the invention, the step of knitting the garment includes the step of knitting a hosiery product that includes a knitted heel pocket.

According to another aspect of the invention, the step of knitting the garment includes the step of knitting an over-the-calf sock having an integrally-formed cuff, leg, heel, foot and toe.

According to another aspect of the invention, the step of knitting the garment includes the step of knitting an over-the-calf sock having an integrally-formed cuff, leg, heel, foot and toe, and further includes the step of knitting a non-patterned cuff, a leg with a color-contrast pattern, a non-patterned heel, a mesh patterned foot and a non-patterned toe.

According to another aspect of the invention, the step of knitting the garment includes the step of knitting an over-the-calf sock having an integrally-formed cuff, leg, heel, foot and toe wherein the leg includes a color contrast pattern comprised of a plurality of mutually-intersecting diagonal knitted stitch lines collectively defining a repeating diamond pattern.

According to another aspect of the invention, the step of knitting the garment includes the step of knitting a color contrast pattern comprising a plurality of mutually-intersecting diagonal knitted stitches.

According to another aspect of the invention, the step of knitting the garment includes the steps of providing 1st, 2nd, 3rd and 4th feed yarns wherein:

1st Feed:

300 denier spandex yarn double covered with 1/20/7 textured nylon yarn (Finger #9);

2nd Feed:

Pattern Yarn: 30/1 Cotton yarn (Finger #1)

Plating Yarn: 20 denier spandex yarn double covered with 1/40/13 textured nylon yarn (Finger #8);

3rd Feed:

300 denier spandex yarn double covered with 1/20/7 textured nylon yarn (Finger #9); and 4th Feed:

Pattern Yarn: 30/1 Cotton yarn (Finger #1)

Plating Yarn: 20 denier spandex yarn double covered with 1/40/13 textured nylon yarn (Finger #8).

According to another aspect of the invention, a method of constructing a circular-knitted compression garment is provided that includes the steps of providing a circular knitting machine adapted for laying in an elastomer inlay compression yarn during circular knitting operation, circular knitting the compression garment with first and second plated pattern yarns collectively defining a predetermined pattern visible on an outer surface of the compression garment, and laying into a structure of the first and second plated pattern yarns an elastomer inlay compression yarn to define an inner surface of the circular-knitted garment. The elastomer inlay compression yarn and the first and second plated pattern yarns collectively define respective inner and outer surfaces of the circular-knitted garment. The garment is knitted according to a step whereby the predetermined pattern of the circular-knitted garment is characterized by extending continuously around a circumference of the garment with the inner surface of the circular-knitted garment being smooth without loops and strings extending into an interior volume of the garment defined by the inner surface of the circular-knitted garment. An elastomer compression inlay yarn is positioned in a predetermined first selection of needles on a first knitting machine finger position. The first and second pattern yarns are positioned in a predetermined second selection of needles on second and third knitting machine finger positions, the first selection of needles and the second selection of needles collectively defining a predetermined pattern. The predetermined second selection of needles is positioned to take on the first and second pattern yarns and the elastomer compression inlay yarn deflect predetermined ones of the second selection of needles radially inwardly during knitting, the predetermined ones of the second selection of needles defining an annular space into which the pattern yarns are positioned in an offset relation to the elastomer compression inlay yarn. The first and second pattern yarns are positioned in a plated relationship to respective outer and inner surfaces of the garment and the elastomer compression yarn is positioned in an inlaid condition to the inner surface of the garment.

According to another aspect of the invention, the elastomer compression yarn is a spandex yarn covered with at least one yarn selected from the group of yarns consisting of nylon, polyester, polypropylene, cotton, rayon, wool and silk.

According to another aspect of the invention, the step of selecting for the first pattern yarn a pattern yarn that has a composition that takes on a dye differently than the second pattern yarn takes on a dye, resulting in a pattern that is distinguished by a different color appearance of the yarns.

According to another aspect of the invention, the step of knitting the predetermined pattern comprises the step of knitting the predetermined pattern with a cotton yarn.

According to another aspect of the invention, the step of knitting the garment includes the step of knitting an over-the-calf sock having an integrally-formed cuff, leg, heel, foot and toe and further includes the step of knitting a non-patterned cuff, a leg with a color-contrast pattern, a non-patterned heel, a mesh patterned foot and a non-patterned toe.

According to another aspect of the invention, the step of knitting the garment includes the step of knitting an over-the-calf sock having an integrally-formed cuff, leg, heel, foot and toe wherein the leg includes a color contrast pattern formed of a plurality of mutually-intersecting diagonal knitted stitch lines collectively defining a repeating diamond pattern.

According to another aspect of the invention, the step of knitting the garment comprises the step of knitting a color contrast pattern comprising a plurality of mutually-intersecting diagonal knitted stitches.

According to another aspect of the invention, a method of constructing a knitted compression hosiery product is provided including the steps of introducing an elastomer compression inlay yarn into a predetermined first selection of needles on a first knitting machine finger position and introducing first and second pattern yarns introduced into a predetermined second selection of needles on second and third knitting machine finger positions, the first selection of needles and the second selection of needles collectively defining a predetermined pattern, and raising the predetermined second selection of needles to take on the first and second pattern yarns. The elastomer compression inlay yarn deflect predetermined ones of the second selection of needles radially inwardly to define an annular space into which the pattern yarns are dropped in an offset relation to the elastomer compression inlay yarn.

According to another aspect of the invention, the method includes the step of knitting a heel pocket into the hosiery product.

According to another aspect of the invention, the method includes the step of knitting a toe into the hosiery product.

According to another aspect of the invention, the method includes the step of utilizing a pattern yarn having a composition that takes on a dye differently than a second pattern or plating yarn takes on a dye, resulting in a pattern that is distinguished by a different color appearance of the pattern yarns from one another.

According to another aspect of the invention, the hosiery product includes a cuff, leg, heel, foot and toe, and further wherein the cuff is non-patterned, the leg includes a color-contrast pattern, the heel is non-patterned, the foot is mesh patterned and the toe is non-patterned.

According to another aspect of the invention, the method includes the step of knitting into the leg a color contrast pattern formed from a plurality of mutually-intersecting diagonal knitted stitch lines collectively defining a repeating diamond pattern.

According to another aspect of the invention, the method includes the step of knitting into the leg a color contrast pattern formed from a plurality of mutually-intersecting diagonal knitted stitch lines collectively defining a plurality of repeating diamonds, and knitting into each diamond at least two distinct and different stitch patterns.

According to another aspect of the invention, the method includes the step of knitting into the leg a color contrast pattern formed from a plurality of mutually-intersecting diagonal knitted stitch lines collectively defining a plurality of repeating diamond shapes that are symmetrical along the length of and around the circumference of the hosiery product, and knitting into each symmetrical diamond shape at least two distinct and different stitch patterns.

According to another aspect of the invention, the method includes the step of knitting into a leg portion of the hosiery product a color contrast pattern formed from a plurality of stitches collectively defining a plurality of patterns and knitting into each pattern at least two distinct and different stitch patterns.

According to another aspect of the invention, a method of constructing a compression garment, for example, a sock, is provided that is formed of a knitted fabric that includes an elastomer compression inlay yarn introduced into a predetermined first selection of needles on a first knitting machine finger position and first and second pattern yarns introduced into a predetermined second selection of needles on second and third knitting machine finger positions. The first selection of needles and the second selection of needles collectively define a predetermined pattern. When the predetermined second selection of needles is raised to take on the first and second pattern yarns, the elastomer compression inlay yarn deflects predetermined ones of the second selection of needles radially inwardly to define an annular space into which the pattern yarns are dropped in an offset relation to the elastomer compression inlay yarn. The first and second pattern yarns are plated to respective outer and inner surfaces of the fabric, and the elastomer compression yarn are inlaid to the inner surface of the fabric.

BRIEF DESCRIPTION OF THE DRAWINGS

The present invention is best understood when the following detailed description of the invention is read with reference to the accompanying drawings and photographic images, in which.

DETAILED DESCRIPTION OF A PREFERRED EMBODIMENT AND BEST MODE

Figure 1:
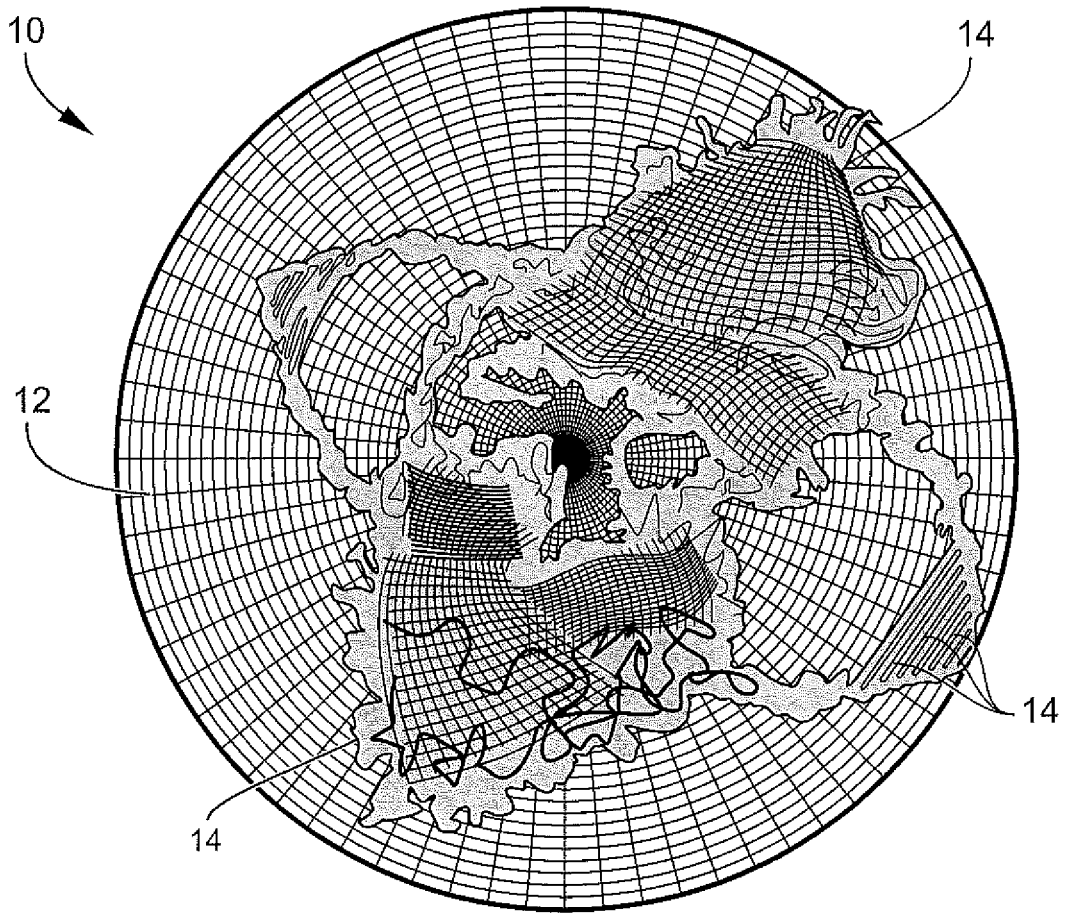
FIG. 1 Prior Art
FIG. 1 is an image of a portion of the inner surface of a compression sock knitted according to prior art methods.

Referring now to the drawings, the image shown in FIG. 1 is of the interior of a conventional prior art compression sock 10 that is designed to give the outward appearance of a typical patterned sock, such as an argyle pattern. As can be seen, the interior surface 12 of the prior art sock 10 is a tangled mass of loose threads, cut thread ends and loops 14. As described above, these artifacts of the prior art knitting process are particularly objectionable when used by wearers who have compromised lower extremity circulation and the loose threads, cut thread ends and loops 14 can cause discomfort and indentations on the surface of the skin of the lower leg. It is also possible that a toe of the wearer can catch in one of the loops when donning the sock.

Figure 2:
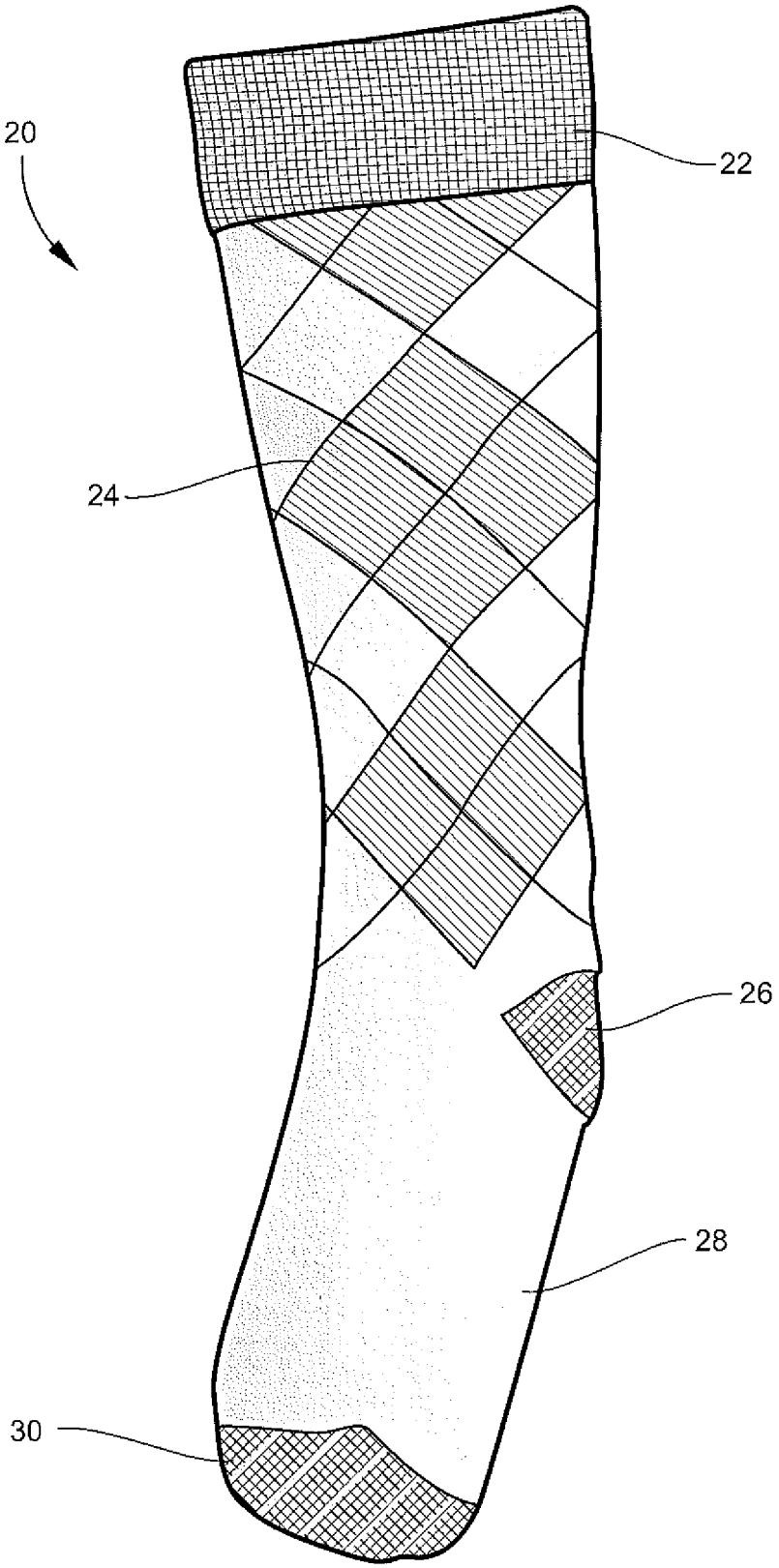
FIG. 2 is a compression sock knitted according to the method of the invention.

As shown in FIG. 2, a compression sock 20 according to an embodiment of the invention includes a cuff 22, leg 24, heel 26, foot 28 and toe 30, respectively. The sock 20 has the outward appearance of a conventional non-compression, patterned hosiery product. This type of product is often desired by individuals who are required to wear compression hosiery products but wish to avoid the heavy, thick appearance of many compression hosiery products. The sock 20 may have characteristics as do conventional socks. For example, the heel 26 may be formed by reciprocation, may be heelless, or may include a non-reciprocated heel pocket. Similarly, the cuff 22 and/or the foot 28 may be patterned or non-patterned.

Figure 3:
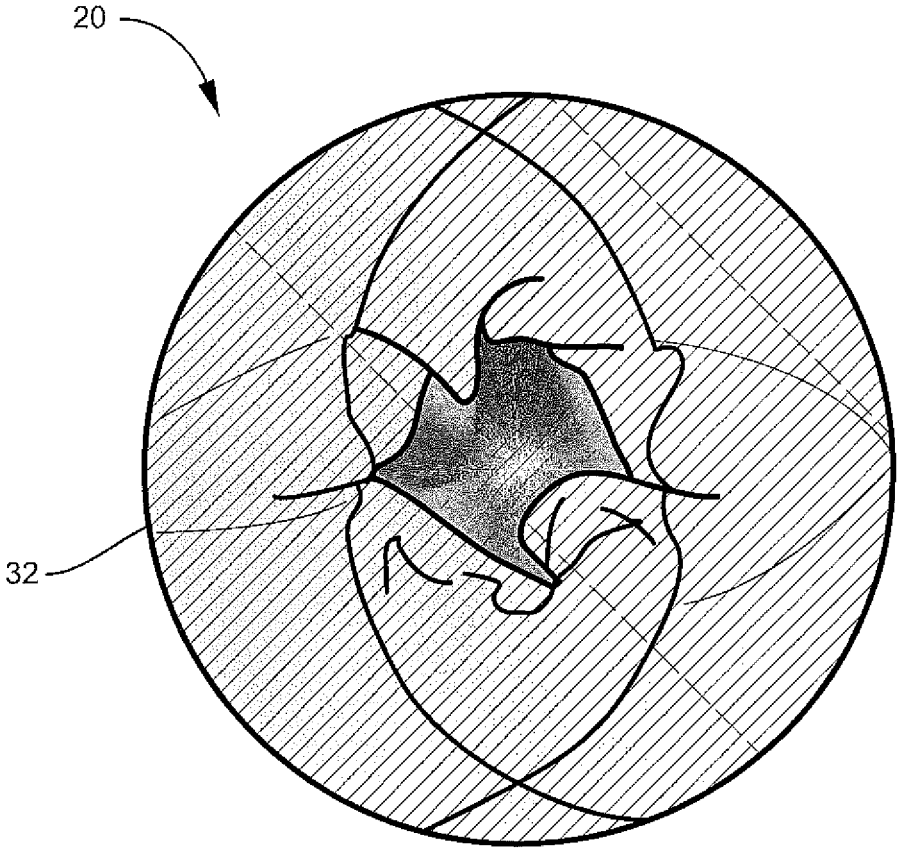
FIG. 3 is an image of the inner surface of the compression sock of FIG. 2.

As shown in FIG. 3, the interior surface 32 of the sock 20 is smooth, even and without any raised or loose threads or loops. This desirable effect is achieved by implementing a new process of plating selected yarns that provide a fully conventional outward appearance while providing medically efficacious compression without the loose threads and loops found in prior art hosiery products. Note that a patterned product does not necessarily imply a distinct color separation between yarns. The pattern may be formed of the same or similar color yarns, in which case the pattern may be indistinct or visible as distinct textures or visible stitch variations.

Design software, such as Photon G616D is used to create the input for a 4-feed compression0 knitting machine, such as a Merz CC4.

Figure 4:
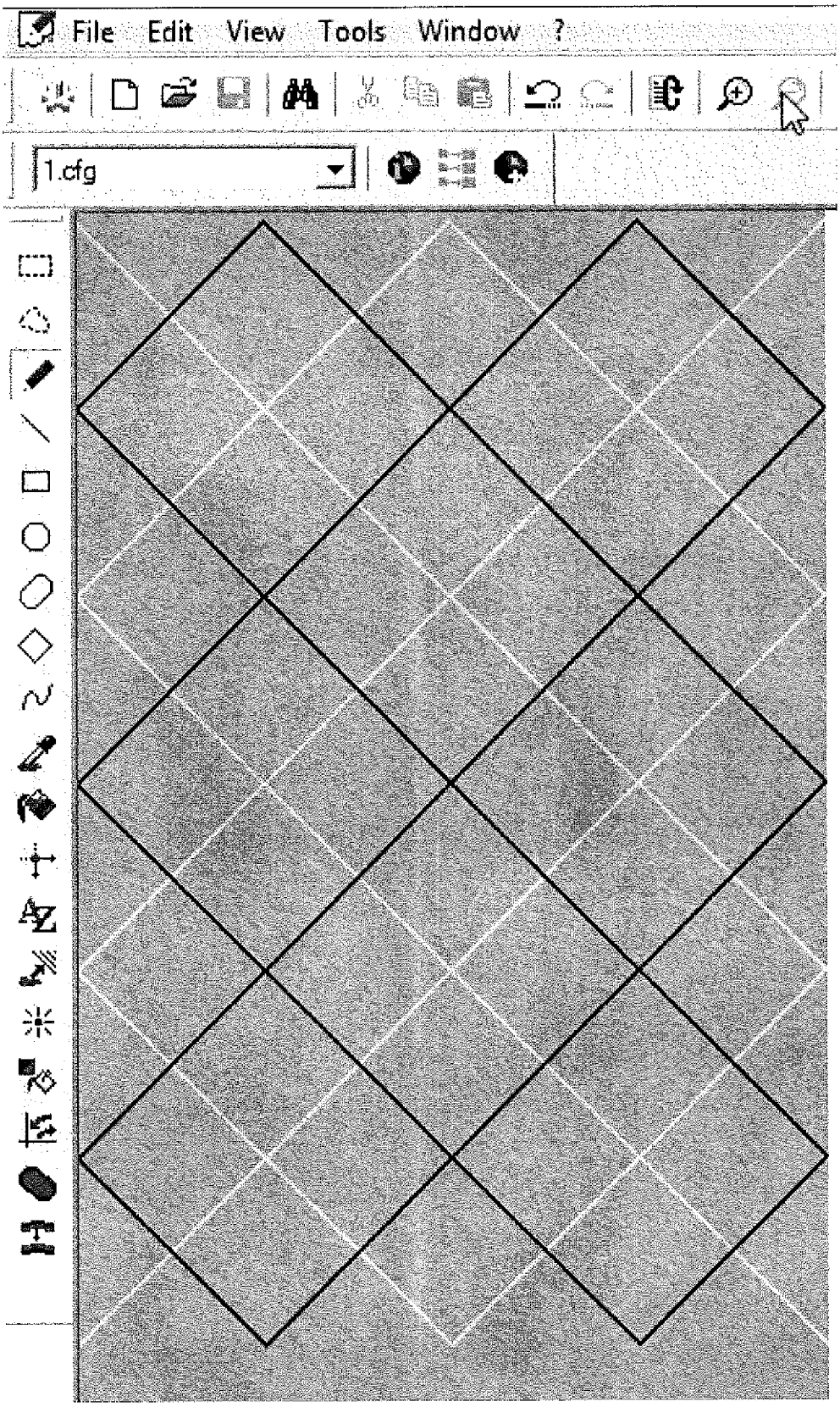
FIGS. 4-11 are sequential views of a design screen showing creation of a compression hosiery pattern using plating techniques.
Figure 5:
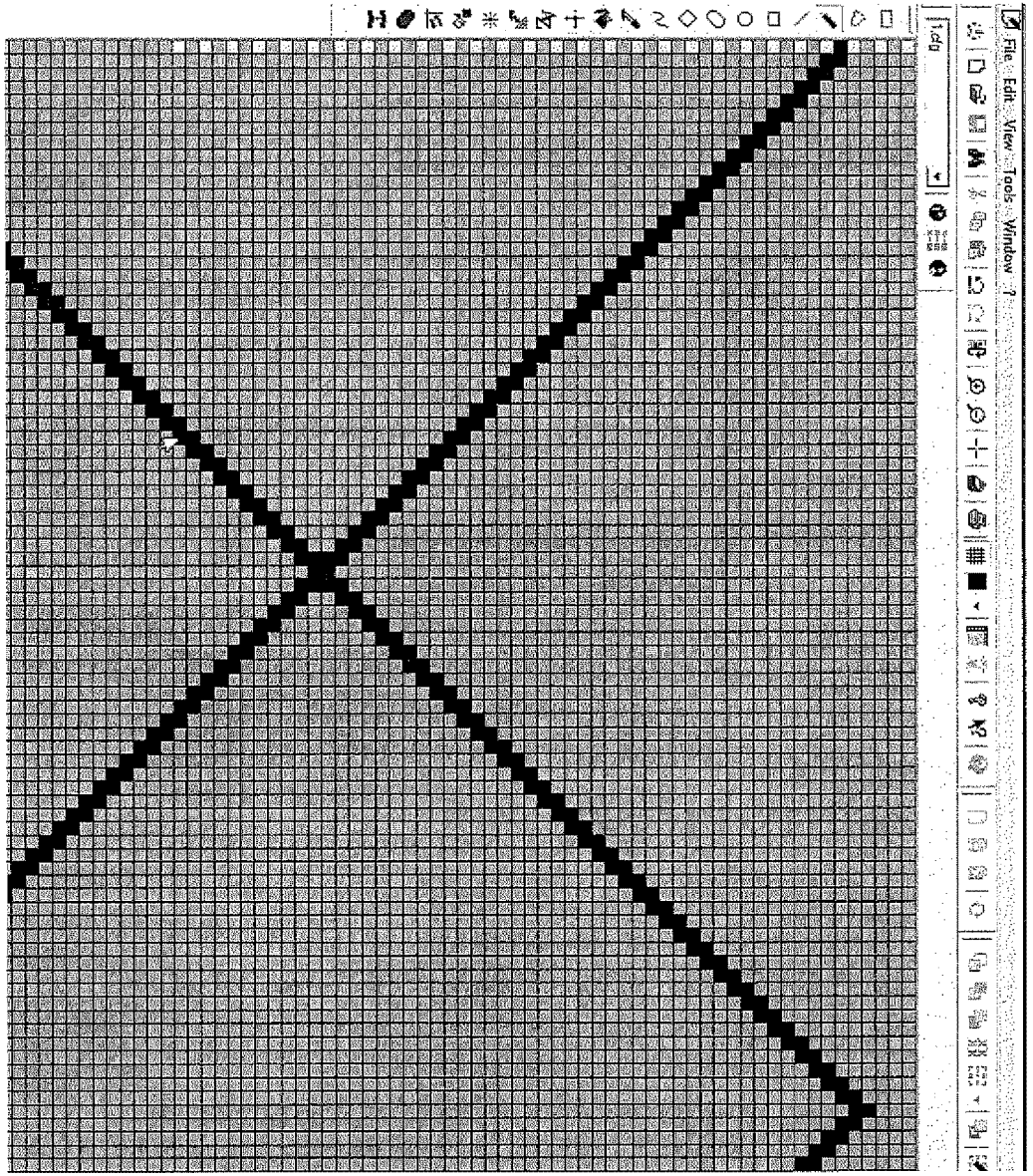
Figure 6:
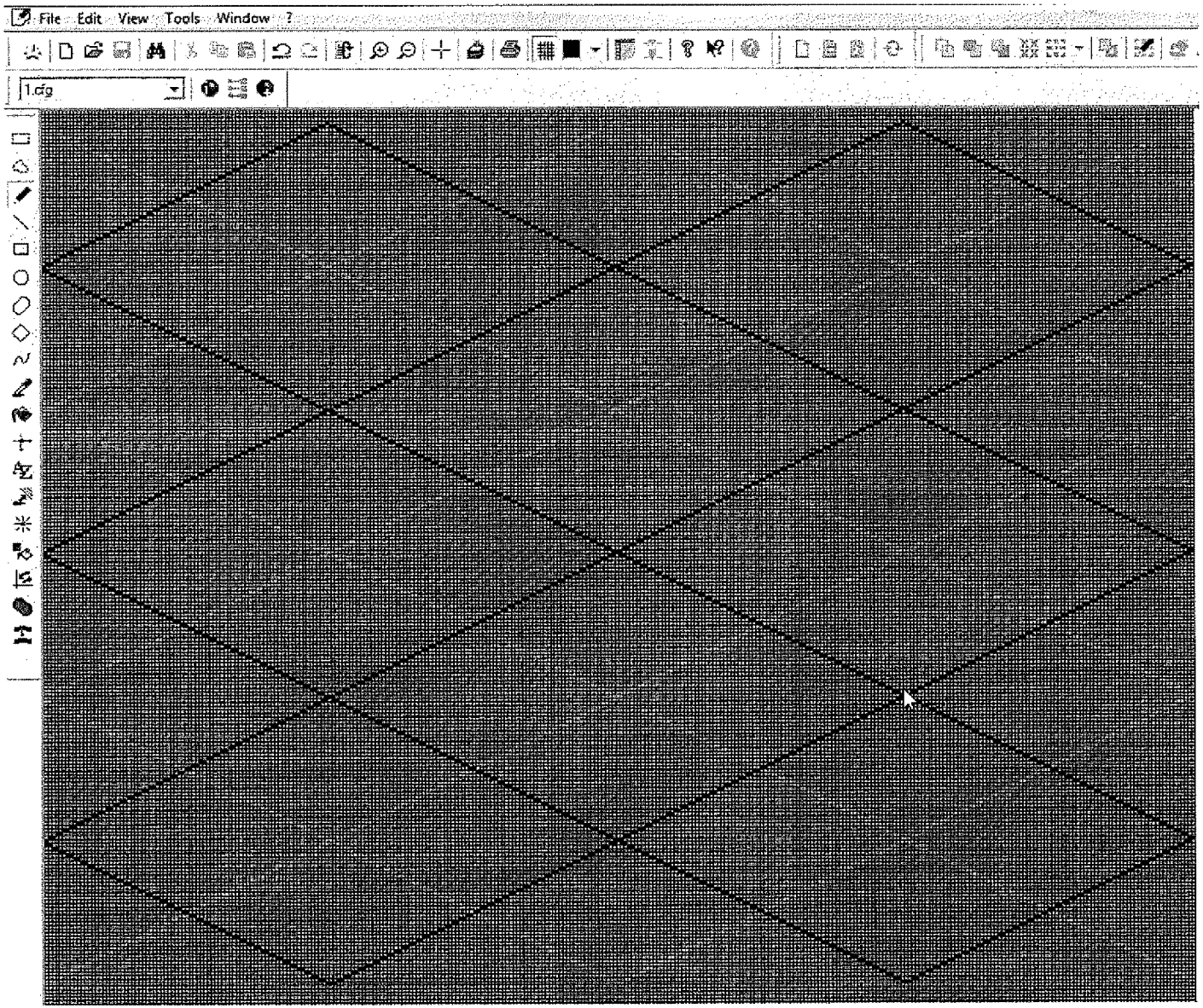

As shown in FIG. 4, the design screen template starts with a grid of 320×556 pixels. According to FIG. 5, using the graphics software pen, odd numbered pixels on a row from top to bottom are selected by, for example, identifying them by a distinct color, such as white. When this step is completed, the template is resized by deleting the odd numbered rows marked in white, leaving a finished template that is 320 pixels wide and 278 pixels deep. See FIG. 6. This template is used for the No. 2 yarn feed on the knitting machine.

Figure 7:
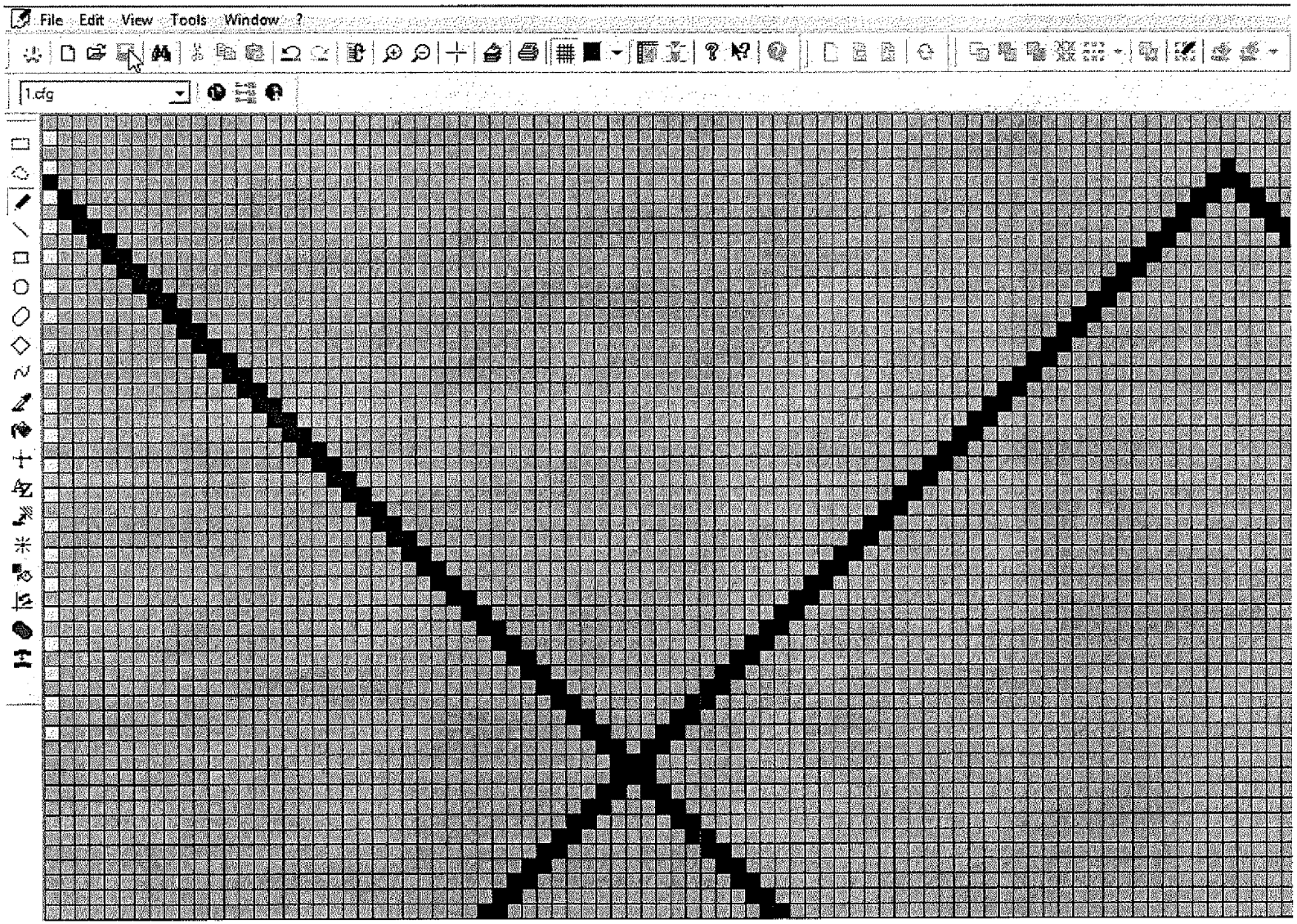
Figure 8:
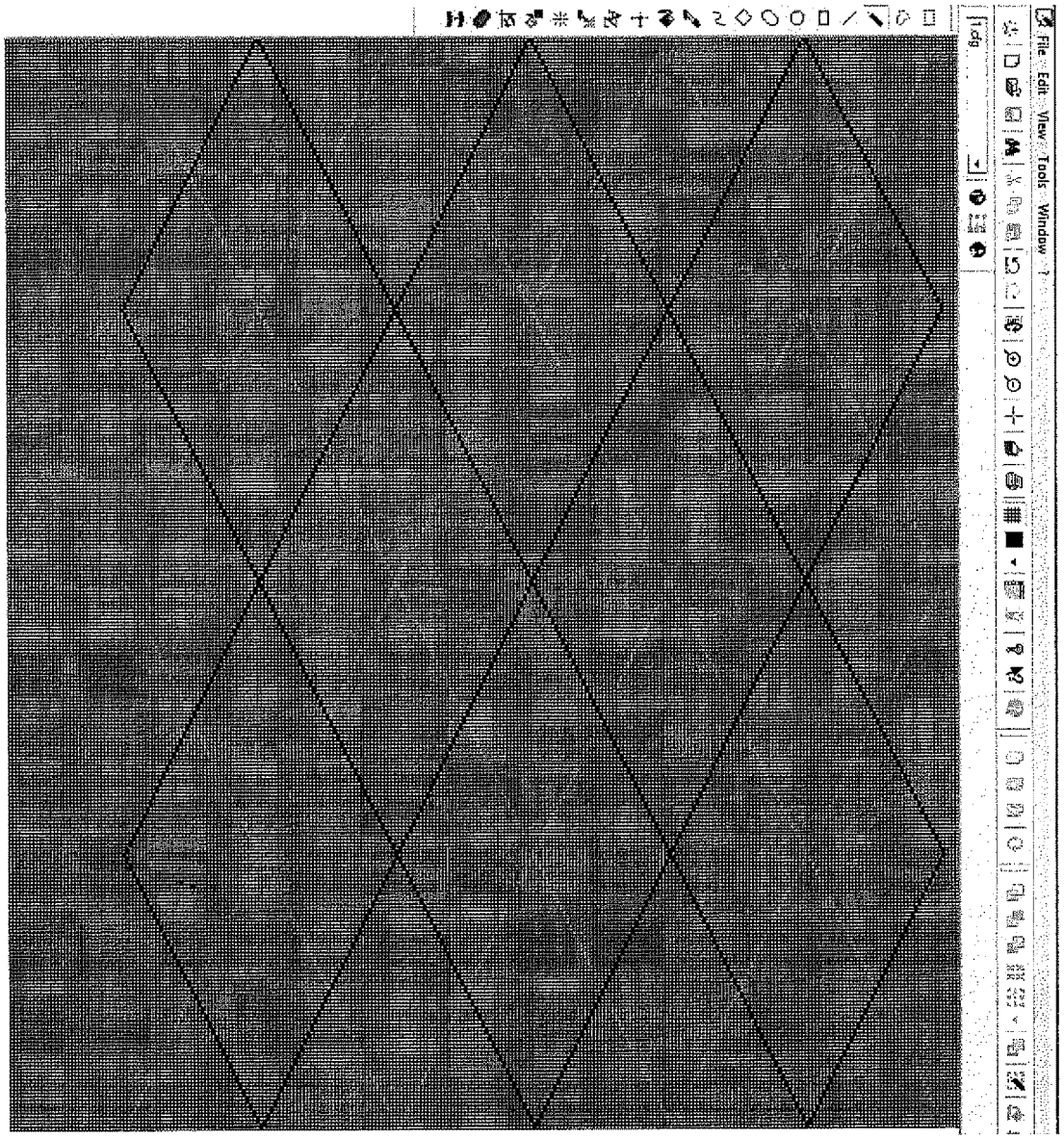

As shown in FIG. 7, using the graphics software pen, even numbered pixels on a row from top to bottom are selected by, for example, identifying them by a distinct color such as white. When this step is completed, the template is resized by deleting the even numbered rows marked in white, leaving a finished template that is 320 pixels wide and 278 pixels deep. See FIG. 8. This template is used for the No. 4 yarn feed on the knitting machine.

Figure 9:
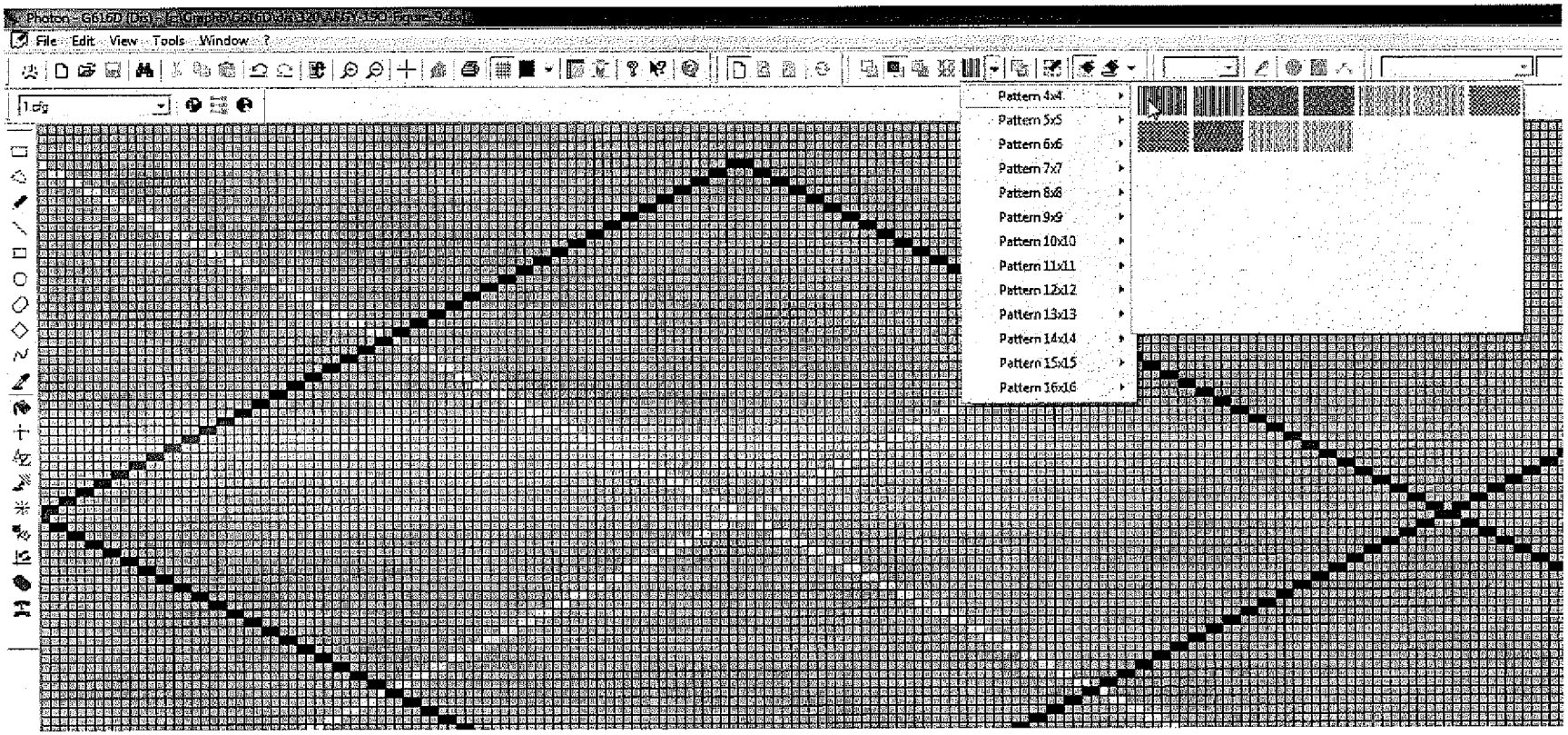
Figure 10:
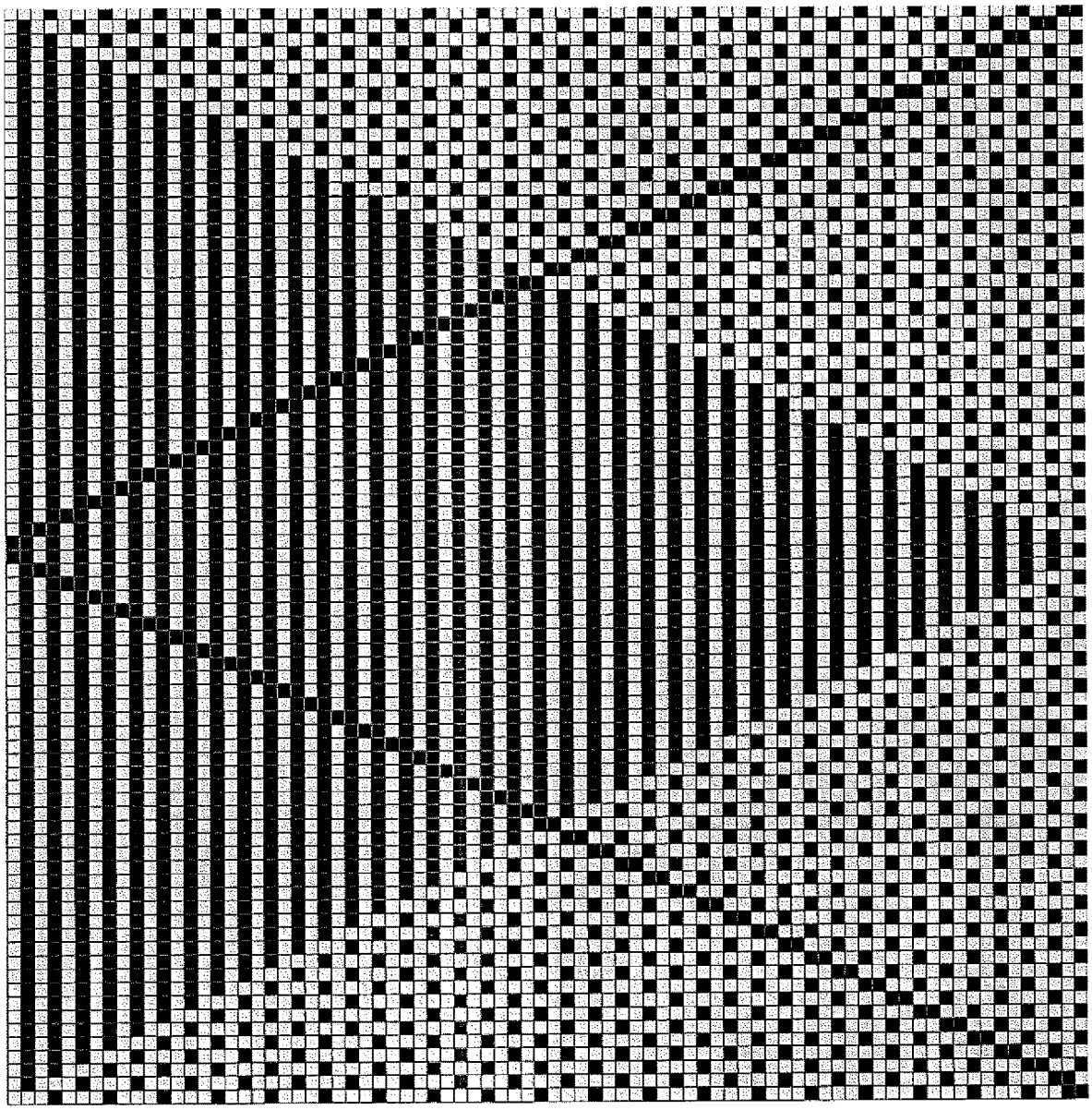
Figure 11:
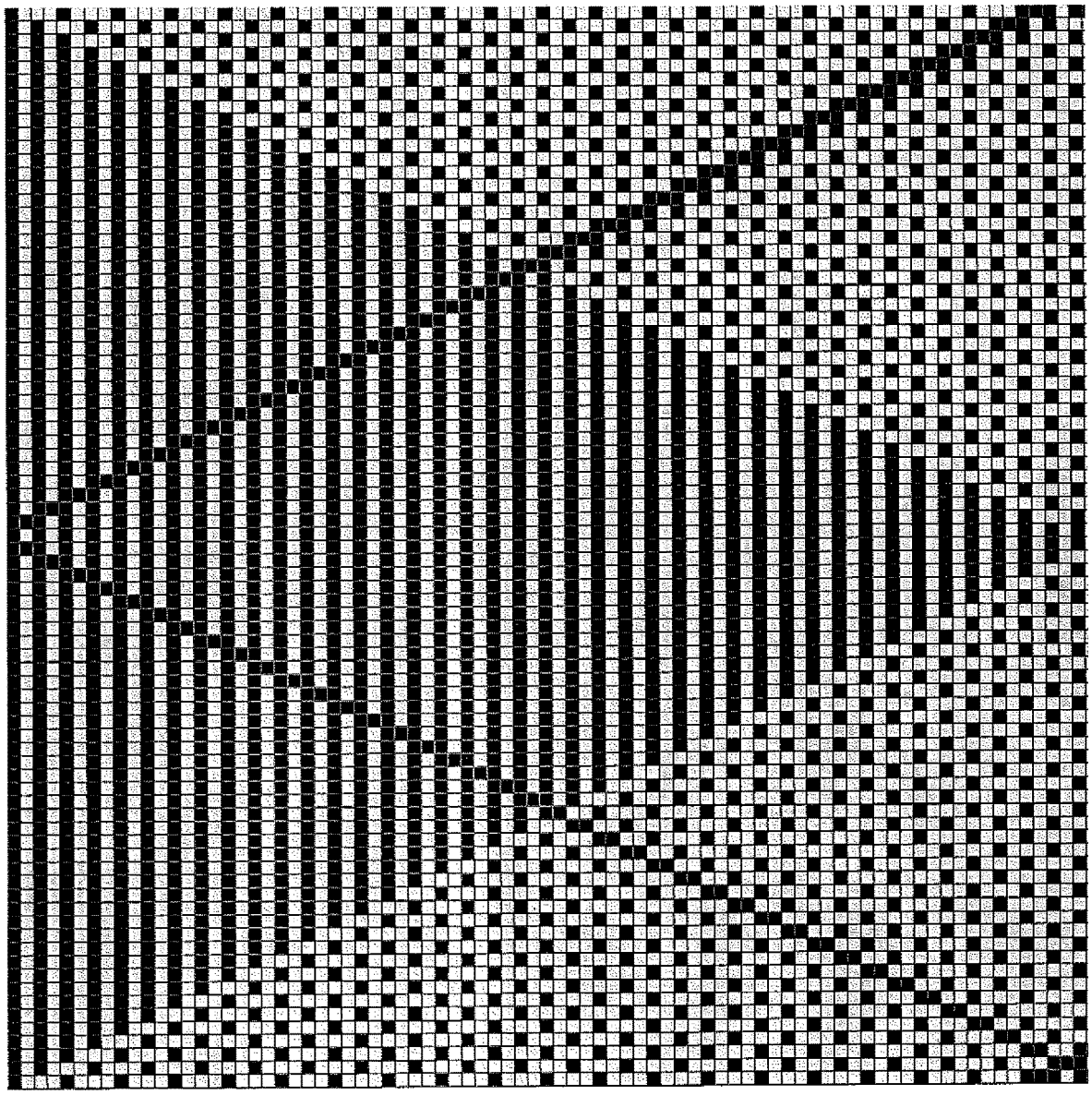
Figure 12:
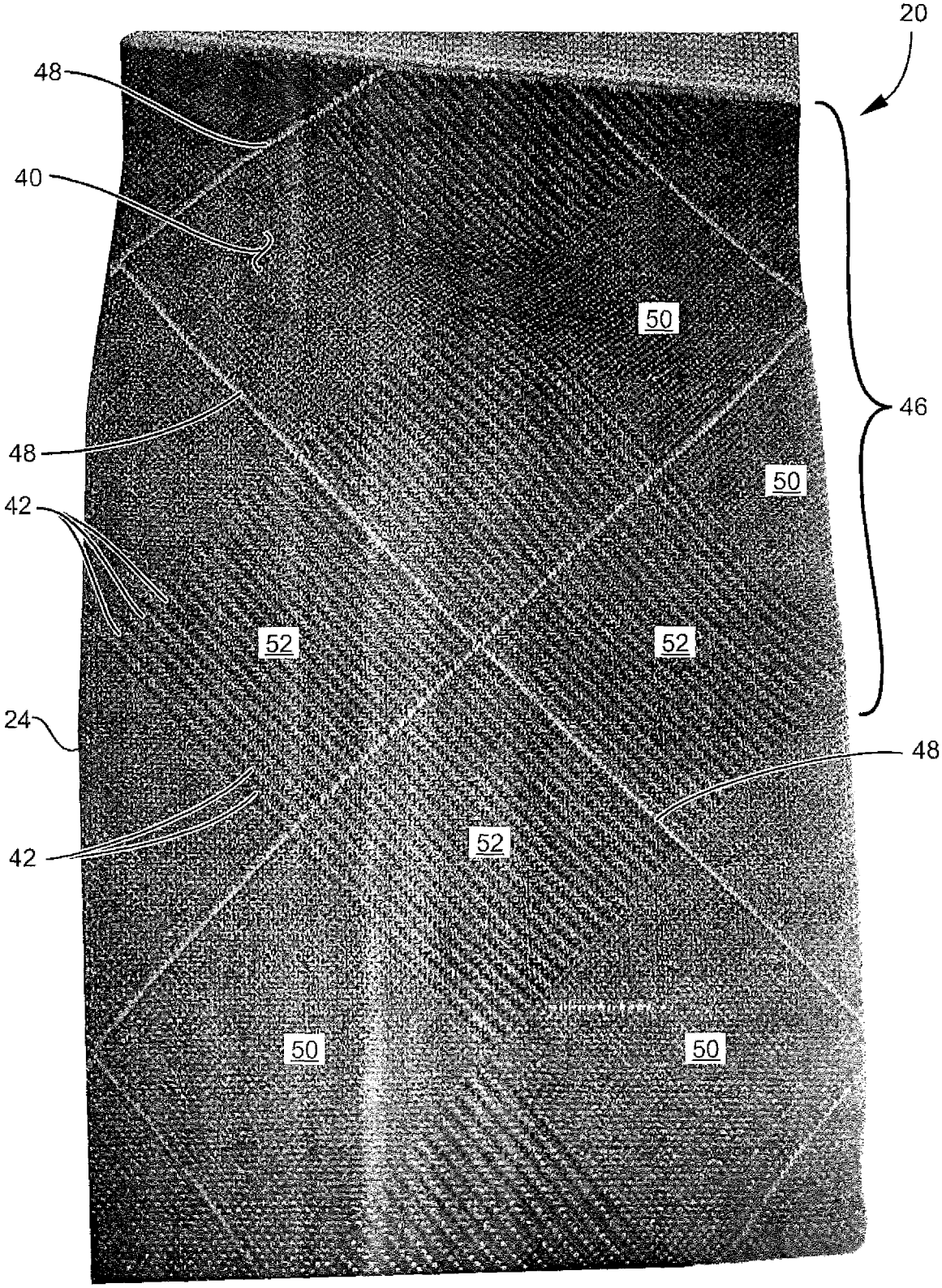
FIG. 12 is a partial detailed view of the exterior surface of the sock shown in FIG. 2.

Referring to FIG. 9, a 320×278 pixel screen is used to flood fill a predetermined pattern, for example, the argyle pattern shown in FIGS. 2 and 12, with a 1×1 mesh pattern indicated by different colors, with horizontal row No. 1 as the starting line indicating the pattern. The remaining pixels are flood filled with the background. See FIG. 10. This template is used for the No. 2 yarn feed. The drop down menu shown in FIG. 9 indicates that numerous mesh patterns can be created that can then be selected to flood fill the different segments of the 320×278 pixel screen shown in FIG. 11. By comparing FIGS. 10 and 11 it will be noted that the pattern designs are offset vertically and horizontally by one stitch in each direction.

With the pixel screen of FIG. 9, starting with horizontal row No. 2, the argyle pattern is flood filled with a 1×1 pattern. The remainder of the pixels are flood-filled with a 1×1 mesh pattern. This template is used for the No, 4-feed.

The knitting machine used for construction of the sock 20 is a 4-feed machine with a 1×1 rib selection starting on the $2^{nd}$ needle for the 1st feed, which is an inlay feed, and a 1×1 rib selection starting on the 1st needle for the 3rd feed, which is also an inlay feed.

An exemplary body yarn construction used to achieve the effects described in this application is as follows:

1st Feed:

300 denier spandex yarn double covered with 1/20/7 textured nylon yarn (Finger #9);

2nd Feed:

Pattern Yarn: 30/1 Cotton yarn (Finger #1)

Plating Yarn: 20 denier spandex yarn double covered with 1/40/13 textured nylon yarn (Finger #8);

3rd Feed:

300 denier spandex yarn double covered with 1/20/7 textured nylon yarn (Finger #9); and 4th Feed:

Pattern Yarn: 30/1 Cotton yarn (Finger #1)

Plating Yarn: 20 denier spandex yarn double covered with 1/40/13 textured nylon yarn (Finger #8).

According to the above, the cotton yarn is threaded through pattern fingers #1 or #2 on the 2nd and 4th feeds, while the double covered nylon is threaded in fingers #7 or #8 on the 2nd and 4th feeds. This provides the maximum separation for both of these yarns. The pattern fingers, #1 or #2 on the $2^{nd}$ and $4^{th}$ feeds are set in the highest and deepest positions possible, but are still able to deliver the yarn to the hooks of the needles in a consistent manner without damaging the needles. Fingers #7 or #8 on the $2^{nd}$ and $4^{th}$ feeds are set in a much lower position, This setup gives additional separation of the two yarns. The elastomer compression yarn 40 may be a spandex covered with at least one yarn selected from the group of yarns consisting of synthetic or bio-based yarns, such as nylon, polyester, polypropylene, cotton, rayon, wool and silk.

As best shown in FIG. 12, yarn 40 is an inner plating yarn, a 20 denier spandex yarn double covered with 1/40/13 textured nylon yarn that knits on all needles and 50 percent is present on the outer surface and 50 percent on the inner surface (not shown). The inlay yarn cannot be seen on the exterior surface of the sock 20. The yarn 42 is a 30/1 Cotton yarn that only knits on the needles that are selected "up" by the pattern. The cotton yarn 42 is present on the outer surface relative to the inner surface at an approximate ratio of 3 to 1, The plating of both yarn 40 and yarn 42 takes place only in the leg 24 and foot 28 on the 2nd and 4th feeds. See FIG. 2

The plating thus includes two yarns being knitted on the same feeds, 2nd and 4th, such that the cotton yarn 42 is plated to the outside of the sock 20 and the spandex/nylon yarn 40 is plated to the inside of the sock 20, without miss-plating. The pattern is created by controlling the needles on the 2nd and 4th feeds that are actually selected "up" to take on the cotton yarn 42.

More specifically, the elastomer compression inlay yarn 40 is introduced to every other needle at tuck height. When the remaining needles are raised to take on the pattern yarns 42, the presence of the inlay yarn 40 deflects the pattern needles inwards, causing every other needle to slightly pull towards the center of the cylinder of the knitting machine. This slight offset, which resembles a "saw tooth" pattern when viewed from above, provides a channel for the pattern yarns 42 to drop into, assuring that they will lay in the proper position. This permits the pattern yarns 42 to be introduced in a controlled manner, avoiding a more random yarn path that could lead to miss-plating. Note also that the inlay yarn 40 can be floated across several needles in an alternative embodiment to form yet another pattern effect.

According to one embodiment, the sock 20 includes a color contrast diamond-shaped pattern 46 knitted into the leg 24 to form a plurality of mutually-intersecting diagonal knitted stitch lines 48 defined by inner plating yarns 48 and collectively defining the repeating diamond-shaped pattern 46.

According to a further embodiment, two distinct and different stitch patterns 50 and 52 are knitted into each pattern 46 to provide a further decorative effect. The diamond-shaped pattern 46 may be symmetrical or asymmetrical, or may be a different geometric shape altogether.

It is known that various natural and synthetic fibers and yarns take on dye differently. These differences may be the result of the basic constituent natural or synthetic materials, physical characteristics of the yarns, treatments applied to the fibers and/or yarns or a combination of these factors. The factors may result in differential coloring or shading. Accordingly, embodiments of the invention can be created using yarns having differential dye take-up characteristics that result in a pattern that is distinguished by a different color and/or shade appearance of one or the other of the pattern yarns in relation to the elastomer compression yarn.

While the disclosure of the invention has been illustrated by explaining the construction of a lower leg and foot garment, i.e., a "sock", the invention is not limited to a sock but is applicable to any knitted compression fabric and garments such as panties, tights, leggings, panty hose, anklets, sleeved upper body articles and the like.

A method for constructing a compression hosiery product according to the invention have been described with reference to specific embodiments and examples. Various details of the invention maybe changed without departing from the scope of the invention. Furthermore, the foregoing description of the preferred embodiments of the invention and best mode for practicing the invention are provided for the purpose of illustration only and not for the purpose of limitation, the invention being defined by the claims.

We claim:

1. A method of constructing a circular-knitted compression garment comprising the steps of:

(a) providing a circular knitting machine adapted for laying in an elastomer inlay compression yarn during circular knitting operation;

(b) circular knitting the compression garment with first and second plated pattern yarns collectively defining a predetermined pattern visible on an outer surface of the compression garment;

(b) laying into a structure of the first and second plated pattern yarns an elastomer inlay compression yarn as a portion of an inner surface of the circular-knitted garment;

(c) the elastomer inlay compression yarn and the first and second plated pattern yarns collectively defining respective inner and outer surfaces of the circular-knitted garment; and (d) knitting the garment according a step whereby the predetermined pattern of the circular-knitted garment is characterized by extending around a circumference of the garment with the inner surface of the circular-knitted garment being smooth without loops and strings extending into an interior volume of the garment defined by the inner surface of the circular-knitted garment.

2. A method of constructing a circular-knitted compression garment according to claim 1, wherein the step of circular knitting the compression garment comprises the step of circular knitting a compression hosiery product.

3. A method of constructing a circular-knitted compression garment according to claim 1, wherein the elastomer compression yarn is a spandex yarn covered with at least one yarn selected from the group of yarns consisting of nylon, polyester, polypropylene, cotton, rayon, wool and silk.

4. A method of constructing a circular-knitted compression garment according to claim 1, and including the step of selecting for the first pattern yarn a pattern yarn that has a composition that takes on a dye differently than the second pattern yarn takes on a dye, resulting in a pattern that is distinguishable by a different color appearance of the yarns.

5. A method of constructing a circular-knitted compression garment according to claim 1, wherein the step of knitting at least one of the first and second pattern yarns comprises the step of knitting with a cotton yarn.

6. A method of constructing a circular-knitted compression garment according to claim 1, wherein step of laying in the elastomer compression yarn comprises the step of laying in a spandex yarn wrapped with two layers of textured nylon yarn.

7. A method of constructing a circular-knitted compression garment according to claim 5, wherein the step of knitting the predetermined pattern of the circular-knitted comprises the step of knitting a predetermined pattern that extends continuously around the circumference of the garment.

8. A method of constructing a circular-knitted compression garment according to claim 1, wherein the step of knitting the garment comprises the step of knitting a hosiery product that includes a knitted heel pocket.

9. A method of constructing a circular-knitted compression garment according to claim 1, wherein the step of knitting the garment comprises the step of knitting an over-the-calf sock having an integrally-formed cuff, leg, heel, foot and toe.

10. A method of constructing a circular-knitted compression garment according to claim 1, wherein the step of knitting the garment comprises the step of knitting an over-the-calf sock having an integrally-formed cuff, leg, heel, foot and toe, and further comprises the step of knitting a non-patterned cuff, a leg with a color-contrast pattern, a non-patterned heel, a mesh patterned foot and a non-patterned toe.

11. A method of constructing a circular-knitted compression garment according to claim 1, wherein the step of knitting the garment comprises the step of knitting an over-the-calf sock having an integrally-formed cuff, leg, heel, foot and toe wherein the leg includes a color contrast pattern comprised of a plurality of mutually-intersecting diagonal knitted stitch lines collectively defining a repeating diamond pattern.

12. A method of constructing a circular-knitted compression garment according to claim 1, wherein the step of knitting the garment comprises the step of knitting a color contrast pattern comprising a plurality of mutually-intersecting diagonal knitted stitches.

13. A method of constructing a circular-knitted compression garment according to claim 1, wherein the step of knitting the garment includes the steps of providing 1st, 2nd, 3rd and 4th feed yarns comprising:

1st Feed:

300 denier spandex yarn double covered with 1/20/7 textured nylon yarn (Finger #9);

2nd Feed:

Pattern Yarn: 30/1 Cotton yarn (Finger #1)

Plating Yarn: 20 denier spandex yarn double covered with 1/40/13 textured nylon yarn (Finger #8);

3rd Feed:

300 denier spandex yarn double covered with 1/20/7 textured nylon yarn (Finger #9); and 4th Feed:

Pattern Yarn: 30/1 Cotton yarn (Finger #1)

Plating Yarn: 20 denier spandex yarn double covered with 1/40/13 textured nylon yarn (Finger #8).

14. A method of constructing a circular-knitted compression garment comprising the steps of:

(a) providing a circular knitting machine adapted for laying in an elastomer inlay compression yarn during circular knitting operation;

(b) circular knitting the compression garment with first and second plated pattern yarns collectively defining a predetermined pattern visible on an outer surface of the compression garment;

(c) laying into a structure of the first and second plated pattern yarns an elastomer inlay compression yarn to define an inner surface of the circular-knitted garment;

(d) the elastomer inlay compression yarn and the first and second plated pattern yarns collectively defining respective inner and outer surfaces of the circular-knitted garment;

(e) knitting the garment according a step whereby the predetermined pattern of the circular-knitted garment is characterized by extending continuously around a circumference of the garment with the inner surface of the circular-knitted garment being smooth without loops and strings extending into an interior volume of the garment defined by the inner surface of the circular-knitted garment;

(f) positioning an elastomer compression inlay yarn in a predetermined first selection of needles on a first knitting machine finger position;

(g) positioning first and second pattern yarns in a predetermined second selection of needles on second and third knitting machine finger positions, the first selection of needles and the second selection of needles collectively defining a predetermined pattern;

(h) positioning the predetermined second selection of needles wherein the predetermined second selection of needles is positioned to take on the first and second pattern yarns;

(i) the elastomer compression inlay yarn deflecting predetermined ones of the second selection of needles radially inwardly during knitting, the predetermined ones of the second selection of needles defining an annular space into which the pattern yarns are positioned in an offset relation to the elastomer compression inlay yarn;

(j) positioning the first and second pattern yarns in a plated relationship to respective outer and inner surfaces of the garment; and (k) positioning the elastomer compression yarn in an inlaid condition to the inner surface of the garment.

15. A method of constructing a circular-knitted compression garment according to claim 14, wherein the step of circular knitting the compression garment comprises the step of circular knitting a compression hosiery product.

16. A method of constructing a circular-knitted compression garment according to claim 14, wherein the step of circular knitting the compression garment comprises the step of circular knitting a fabric compression hosiery product.

17. A method of constructing a circular-knitted compression garment according to claim 14, wherein the elastomer compression yarn is a spandex yarn covered with at least one yarn selected from the group of yarns consisting of nylon, polyester, polypropylene, cotton, rayon, wool and silk.

18. A method of constructing a circular-knitted compression garment according to claim 14, and including the step of selecting for the first pattern yarn a pattern yarn that has a composition that takes on a dye differently than the second pattern yarn takes on a dye, resulting in a pattern that is distinguished by a different color appearance of the yarns.

19. A method of constructing a circular-knitted compression garment according to claim 14, wherein the step of knitting the predetermined pattern of the circular-knitted garment comprises the step of knitting a predetermined pattern that extends continuously around the circumference of the garment.

20. A method of constructing a circular-knitted compression garment according to claim 14, wherein step of laying in the elastomer compression yarn comprises the step of laying in a spandex yarn wrapped with two layers of textured nylon yarn.

21. A method of constructing a circular-knitted compression garment according to claim 19, wherein the step of knitting the predetermined pattern comprises the step of knitting the predetermined pattern with a cotton yarn.

22. A method of constructing a circular-knitted compression garment according to claim 14, wherein the step of knitting the garment comprises the step of knitting a hosiery product that includes a knitted heel pocket.

23. A method of constructing a circular-knitted compression garment according to claim 14, wherein the step of knitting the garment comprises the step of knitting an over-the-calf sock having an integrally-formed cuff, leg, heel, foot and toe.

24. A method of constructing a circular-knitted compression garment according to claim 14, wherein the step of knitting the garment comprises the step of knitting an over-the-calf sock having an integrally-formed cuff, leg, heel, foot and toe and further comprises the step of knitting a non-patterned cuff, a leg with a color-contrast pattern, a non-patterned heel, a mesh patterned foot and a non-patterned toe.

25. A method of constructing a circular-knitted compression garment according to claim 14, wherein the step of knitting the garment comprises the step of knitting an over-the-calf sock having an integrally-formed cuff, leg, heel, foot and toe wherein the leg includes a color contrast pattern comprised of a plurality of mutually-intersecting diagonal knitted stitch lines collectively defining a repeating diamond pattern.

26. A method of constructing a circular-knitted compression garment according to claim 14, wherein the step of knitting the garment comprises the step of knitting a color contrast pattern comprising a plurality of mutually-intersecting diagonal knitted stitches.

27. A method of constructing a circular-knitted compression garment according to claim 14, wherein the step of knitting the garment includes the steps of providing 1st, 2nd, 3rd and 4th feed yarns comprising:

1st Feed:

300 denier spandex yarn double covered with 1/20/7 textured nylon yarn (Finger #9);

2nd Feed:

Pattern Yarn: 30/1 Cotton yarn (Finger #1)

Plating Yarn: 20 denier spandex yarn double covered with 1/40/13 textured nylon yarn (Finger #8);

3rd Feed:

300 denier spandex yarn double covered with 1/20/7 textured nylon yarn (Finger #9); and 4th Feed:

Pattern Yarn: 30/1 Cotton yarn (Finger #1)

Plating Yarn: 20 denier spandex yarn double covered with 1/40/13 textured nylon yarn (Finger #8).

28. A method of constructing a knitted compression hosiery product comprising the steps of:

(a) introducing an elastomer compression inlay yarn into a predetermined first selection of needles on a first knitting machine finger position;

(b) introducing first and second pattern yarns introduced into a predetermined second selection of needles on second and third knitting machine finger positions, the first selection of needles and the second selection of needles collectively defining a predetermined pattern;

(c) raising the predetermined second selection of needles to take on the first and second pattern yarns;

(d) the elastomer compression inlay yarn deflecting predetermined ones of the second selection of needles radially inwardly to define an annular space into which the pattern yarns are dropped in an offset relation to the elastomer compression inlay yarn;

(e) knitting a non-elastomer pattern yarn and an elastomer pattern or plating yarn on a fourth machine feed;

plating the pattern yarns of the second and fourth feeds to an outer surface of the fabric; and (g) inlaying the elastomer compression yarn to the inner surface of the fabric.

29. A method of constructing a compression hosiery product according to claim 28, wherein the steps of introducing the elastomer compression yarn and the first and second pattern yarns comprise feeding yarns to the four feeds of the knitting machine according to the following specification:

1st Feed:

300 denier spandex yarn double covered with 1/20/7 textured nylon yarn (Finger #9);

2nd Feed:

Pattern Yarn: 30/1 Cotton yarn (Finger #1)

Plating Yarn: 20 denier spandex yarn double covered with 1/40/13 textured nylon yarn (Finger #8);

3rd Feed:

300 denier spandex yarn double covered with 1/20/7 textured nylon yarn (Finger #9); and $4^{th}$ Feed:

Pattern Yarn: 30/1 Cotton yarn (Finger #1)

Plating Yarn: 20 denier spandex yarn double covered with 1/40/13 textured nylon yarn (Finger #8).

30. A method of constructing a compression hosiery product according to claim 28, and including the step of knitting a heel pocket into the hosiery product.

31. A method of constructing a compression hosiery product according to claim 28, and including the step of knitting a toe into the hosiery product.

32. A method of constructing a compression hosiery product according to claim 28, and including the step of utilizing a pattern yarn having a composition that takes on a dye differently than a second pattern or plating yarn takes on a dye, resulting in a pattern that is distinguished by a different color appearance of the pattern yarns from one another.

33. A method of constructing a compression hosiery product according to claim 28, wherein the hosiery product includes a cuff, leg, heel, foot and toe, and further wherein the cuff is non-patterned, the leg includes a color-contrast pattern, the heel is non-patterned, the foot is mesh patterned and the toe is non-patterned.

34. A method of constructing a compression hosiery product according to claim 33, and including the step of knitting into the leg a color contrast pattern formed from a plurality of mutually-intersecting diagonal knitted stitch lines collectively defining a repeating diamond pattern.

35. A method of constructing a compression hosiery product according to claim 34, and including the step of knitting into the leg a color contrast pattern formed from a plurality of mutually-intersecting diagonal knitted stitch lines collectively defining a plurality of repeating diamonds, and knitting into each diamond at least two distinct and different stitch patterns.

36. A method of constructing a compression hosiery product according to claim 34, and including the step of knitting into the leg a color contrast pattern formed from a plurality of mutually-intersecting diagonal knitted stitch lines collectively defining a plurality of repeating diamond shapes that are symmetrical along the length of and around the circumference of the hosiery product, and knitting into each symmetrical diamond shape at least two distinct and different stitch patterns.

37. A method of constructing a compression hosiery product according to claim 28, and including the step of knitting into a leg portion of the hosiery product a color contrast pattern formed from a plurality of stitches collectively defining a plurality of patterns and knitting into each pattern at least two distinct and different stitch patterns.

* * * * *